US010107480B1

(12) United States Patent
Ladewig et al.

(10) Patent No.: US 10,107,480 B1
(45) Date of Patent: Oct. 23, 2018

(54) LIGHT FIXTURE WITH PIVOTING SENSOR ASSEMBLY

(71) Applicants: Christopher Gerard Ladewig, Fayetteville, GA (US); James Richard Christ, Peachtree City, GA (US); Gregg Lehman, Peachtree City, GA (US)

(72) Inventors: Christopher Gerard Ladewig, Fayetteville, GA (US); James Richard Christ, Peachtree City, GA (US); Gregg Lehman, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 469 days.

(21) Appl. No.: 14/829,430

(22) Filed: Aug. 18, 2015

(51) Int. Cl.

| | |
|---|---|
| ***F21V 33/00*** | (2006.01) |
| ***F21V 17/02*** | (2006.01) |
| ***F21V 23/04*** | (2006.01) |
| ***F21S 8/04*** | (2006.01) |
| ***F21S 8/00*** | (2006.01) |
| ***F21V 15/01*** | (2006.01) |
| ***F21V 23/00*** | (2015.01) |

(52) U.S. Cl.
CPC ..... *F21V 17/02* (2013.01); *F21S 8/036* (2013.01); *F21S 8/046* (2013.01); *F21V 15/01* (2013.01); *F21V 23/003* (2013.01); *F21V 23/0471* (2013.01)

(58) Field of Classification Search
CPC ..... F21V 17/02; F21V 15/01; F21V 23/003; F21V 23/0471; F21S 8/036; F21S 8/046
USPC ..... 362/234
See application file for complete search history.

(56) References Cited

U.S. PATENT DOCUMENTS

2014/0268881 A1* 9/2014 Ku ..... F21V 23/0464 362/642
2015/0092408 A1* 4/2015 Wallach ..... H05B 37/0227 362/233

* cited by examiner

*Primary Examiner* — Anh Mai
*Assistant Examiner* — Meghan Ulanday
(74) *Attorney, Agent, or Firm* — King & Spalding LLP

(57) ABSTRACT

A light fixture includes one or more light modules and a sensor module coupled to a housing of the light fixture. The sensor module includes an extension arm and a sensor unit that is rotatably coupled to one end of the extension arm. The other end of the extension arm that is opposite to the end coupled to the sensor unit is pivotably coupled to the housing of the light fixture to pivotably rotate the sensor module between a first position and a second position based on a mounting of the light fixture. Further, the sensor unit is adjustable independent of the extension arm.

15 Claims, 13 Drawing Sheets

LIGHT FIXTURE WITH PIVOTING SENSOR ASSEMBLY

TECHNICAL FIELD

Embodiments of the present disclosure relate generally to light fixtures, and more particularly to a light fixture that has a pivoting sensor, such as a motion sensor.

BACKGROUND

Motion activated light fixtures may include at least one or more light sources and a motion sensor located adjacent to the one or more light sources. The motion sensor may be positioned such that it has an unobstructed view of an area that is to be illuminated by the one or more light sources. However, in some cases, such as when the motion activated light fixture is mounted on a ceiling or an overhang, the one or more light sources may physically block the motion sensor from a view of the area to be illuminated and/or objects it is intended to sense. The above-mentioned deficiency can be overcome by designing motion activated light fixtures designed specifically to be mounted on the ceiling or overhang. However, having different light fixtures for different mountings, e.g., one for ceiling mounting and another for other type of mounting, such as wall mounting, would mean increased product stock keeping units (SKUs) and less product compatibility. Therefore, there is a need for a motion activated light fixture that can effectively operate both in a wall mounted position and a ceiling mounted position.

SUMMARY

In one aspect, the present disclosure can relate to a light fixture. The light fixture includes a housing, one or more light modules coupled to a portion of the housing, and a sensor module coupled to another portion of the housing. The sensor module includes an extension arm that is pivotably coupled to the another portion of the housing at a first end of the extension arm. Further, the sensor module includes a sensor unit that is rotatably coupled to a second end of the extension arm that is opposite the first end. The sensor module is adjustable between a first position and a second position.

In another aspect, the present disclosure can relate to light fixture. The light fixture comprises a housing that has a recess portion. Further, the light fixture includes one or more light modules that are coupled to the housing. Furthermore, the light fixture includes a sensor module that is pivotably coupled to the housing such that the sensor module pivots between a first position where the sensor module is disposed within the recess and a second position where the sensor module is extended out and away from the recess.

In yet another aspect, the present disclosure can relate to a motion sensor module. The motion sensor module includes an extension arm that is adapted to be rotatably coupled to a housing of a light fixture at a first end, and a motion sensor unit that is rotatably coupled to a second end of the extension arm that is opposite to the first end. The extension arm pivots between a first position where the motion sensor module is disposed within a recess of the housing and a second position where the motion sensor module is extended out and away from the recess of the housing.

These and other aspects, objects, features, and embodiments will be apparent from the following description and the appended claims.

BRIEF DESCRIPTION OF THE DRAWINGS

For a more complete understanding of the disclosure and the advantages thereof, reference is now made to the following description, in conjunction with the accompanying figures briefly described as follows.

Figure 1A:
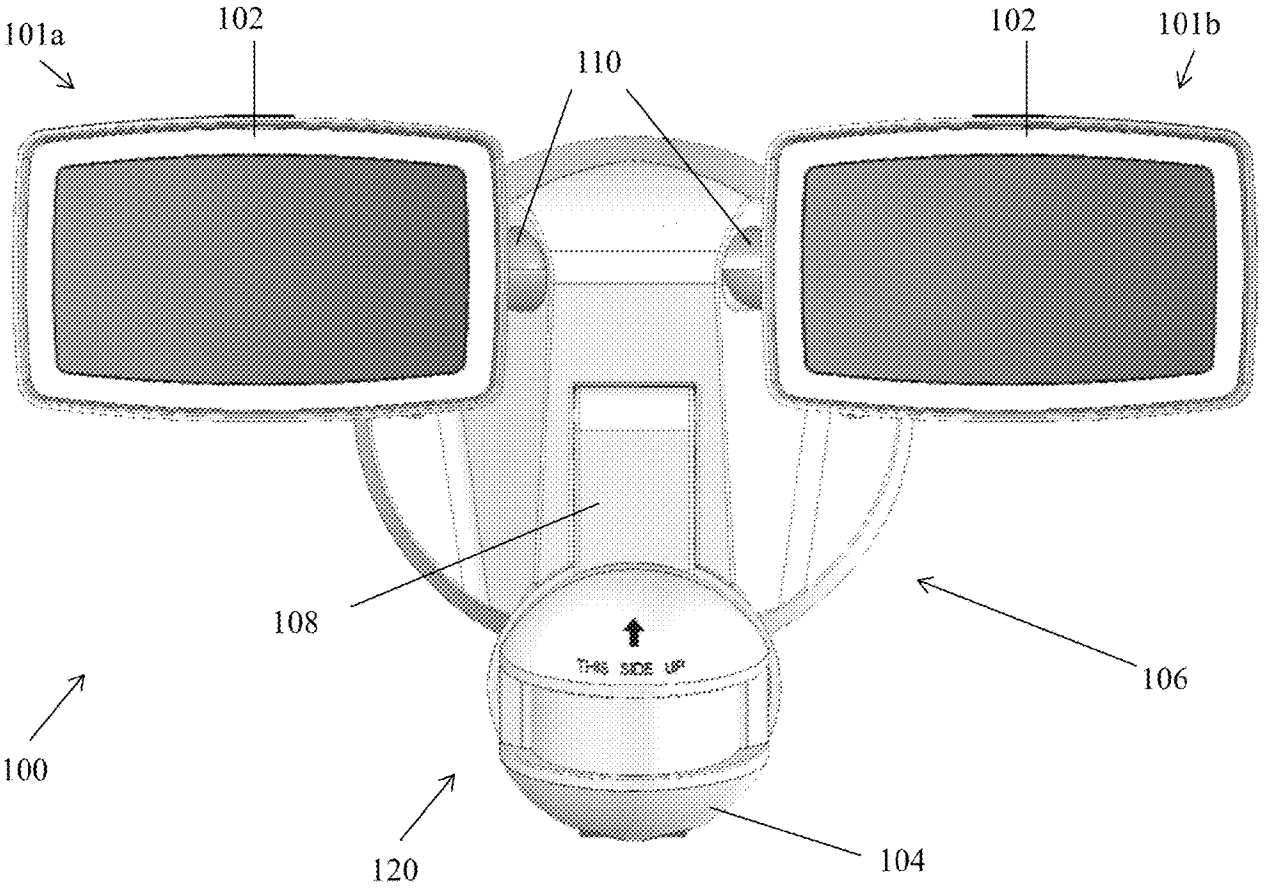
FIG. 1A illustrates a front view of a light fixture having an adjustable motion sensor where the adjustable motion sensor is in a retracted position, in accordance with example embodiments of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of example embodiments of the present disclosure. Additionally, certain dimensions may be exaggerated to help visually convey such principles.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure provides an example light fixture having an adjustable motion sensor (herein interchangeably referred to as 'motion activated light fixture' or 'light fixture'). In particular, the motion activated light fixture includes one or more light modules and a motion sensor module coupled to a housing of the motion activated light fixture. The motion sensor module includes an extension arm and a motion sensor unit coupled to one end of the extension arm. The other end of the extension arm that is opposite to the end coupled to the motion sensor unit is pivotably coupled to the housing of the motion activated light fixture such that the extension arm pivots about an axis passing through the point(s) of intersection of the extension arm with the housing. In particular, the extension arm is configured to pivot such that the motion sensor module extends out and retracts back into a recess in the housing. For example, when the motion activated light fixture is wall mounted, the extension arm and thereby the motion sensor unit coupled to the extension arm may be retracted into the recess in the housing. However, when the motion activated light fixture is ceiling mounted, the extension arm and the motion sensor unit coupled to the extension arm may be extended out and away from the recess in the housing. Accordingly, the present disclosure provides one motion activated light fixture that can be effectively used for both wall mounting and ceiling mounting.

Furthermore, the motion sensor unit may be rotatably coupled to the extension arm providing an additional degree of adjustment for the motion sensor module. That is, the motion sensor unit can be adjusted to point the motion sensor in a desired direction independent of a motion of the extension arm. Accordingly, the motion sensor unit may be adjustable in at least two different ways, one based on the extension and retraction motion of the extension arm responsive to the pivotable coupling of the extension arm to the housing of the light fixture, and another based on a rotation of the motion sensor unit responsive to the rotatable coupling of the motion sensor unit to the extension arm. The rotatable coupling of the motion sensor unit to the extension arm permits the motion sensor unit to rotate regardless of the position of the extension arm. In other words, the motion sensor unit rotates independent of the position of the extension arm.

Even though the present disclosure describes a motion sensor, one of ordinary skill in the art can understand and appreciate that any other type of sensors or electronic devices may be used without departing from a broader scope of the present disclosure. For example, the motion sensor may be replaced by a camera, a daylight sensor, ambient light sensor, etc., without departing from a broader scope of the present disclosure.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "exemplary embodiments" given herein are intended to be non-limiting and among others supported by representations of the present technology.

Figure 1B:
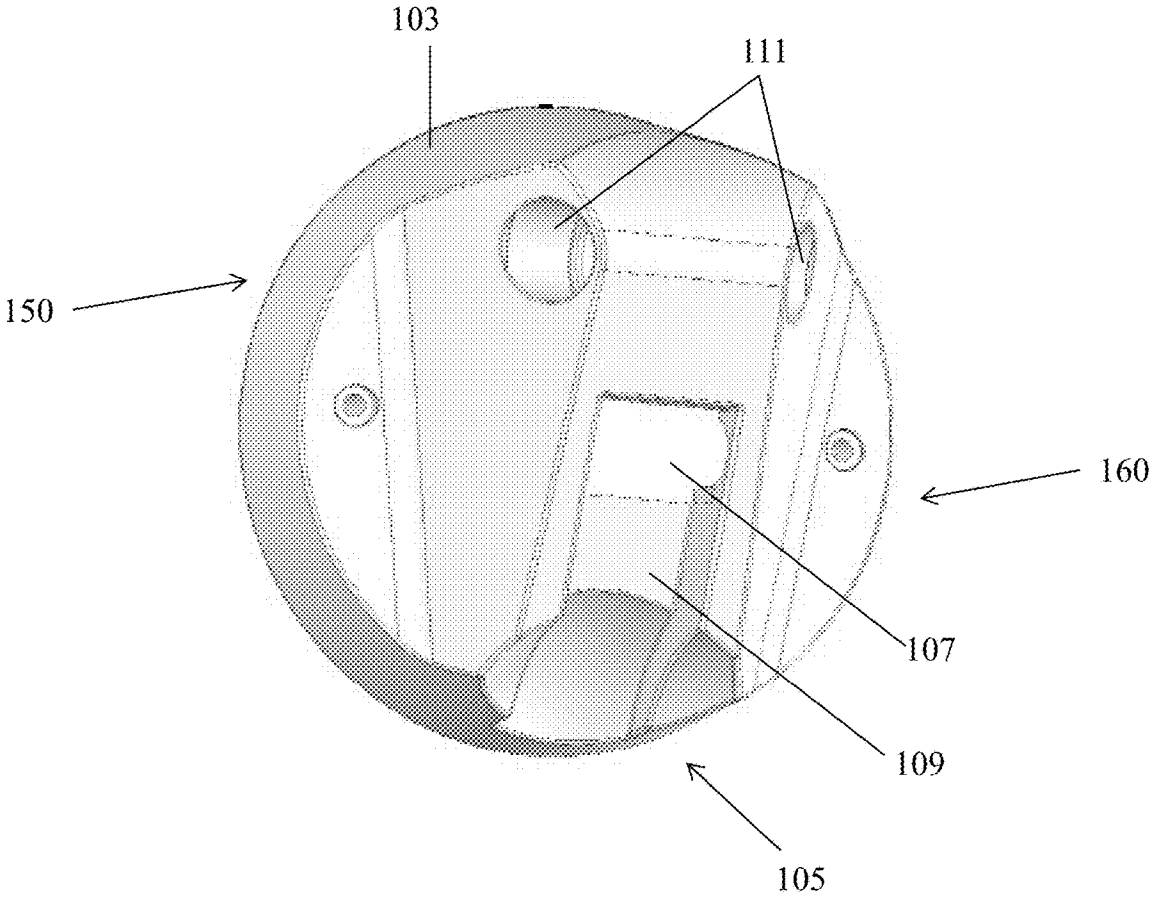
FIG. 1B illustrates a canopy member of the housing of the light fixture, in accordance with example embodiments of the present disclosure.
Figure 2:
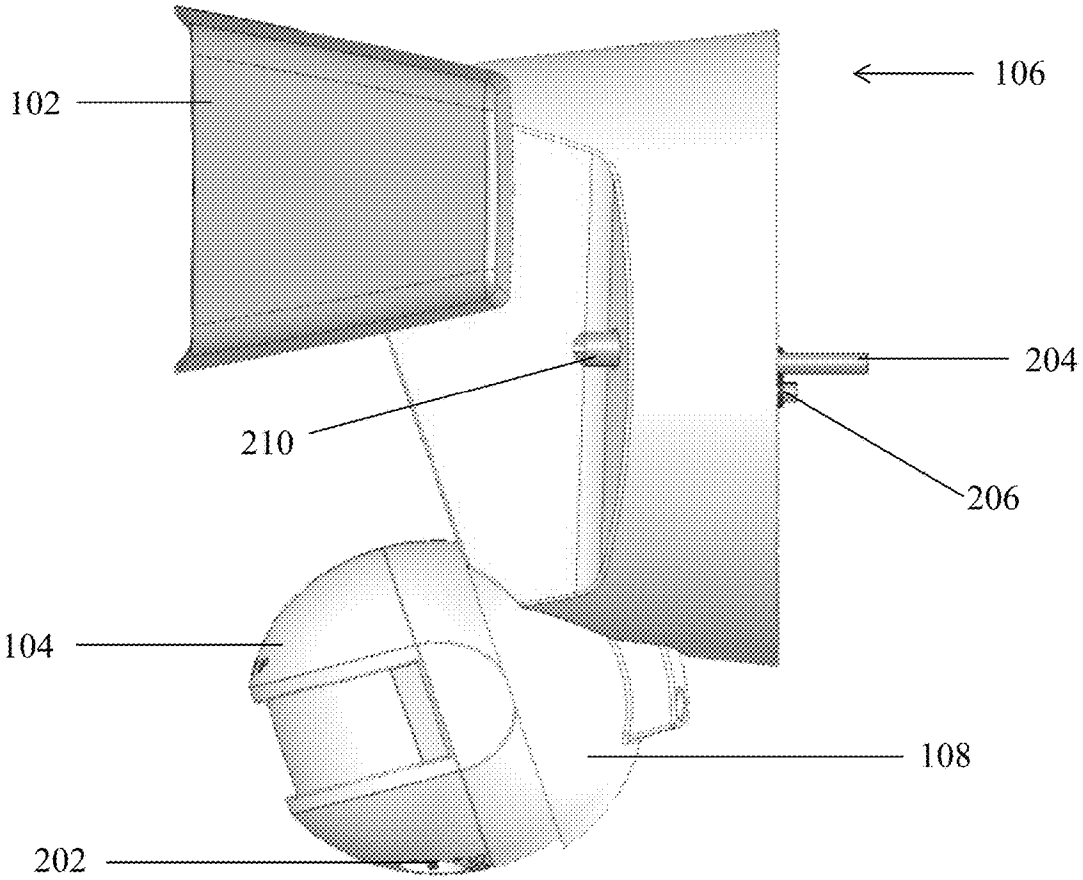
FIG. 2 illustrates a side view of the light fixture of FIG. 1A, in accordance with example embodiments of the present disclosure.
Figure 3:
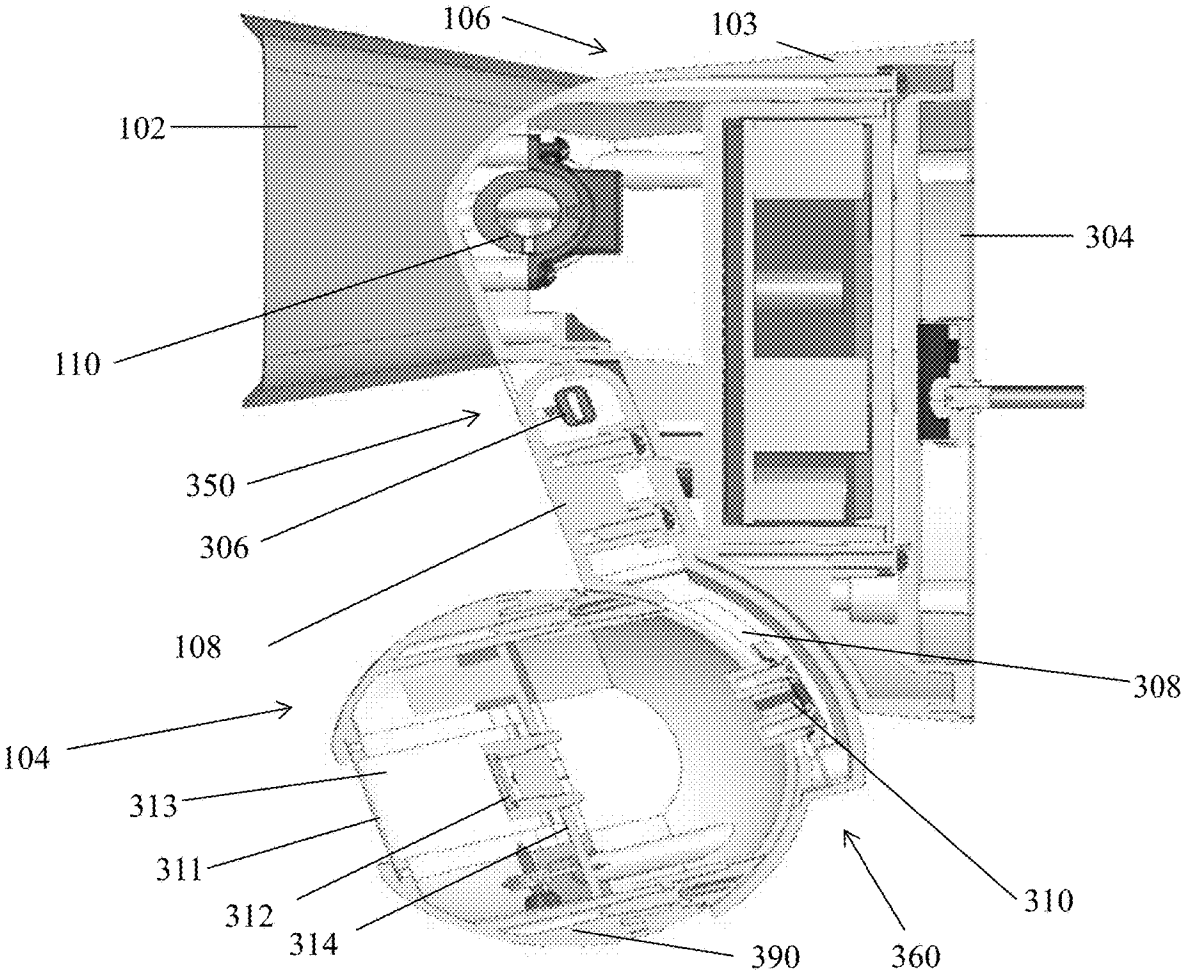
FIG. 3 illustrates a cross-sectional view of the light fixture where the adjustable motion sensor is in the retracted position as illustrated in FIGS. 1A and 2, in accordance with example embodiments of the present disclosure.
Figure 4:
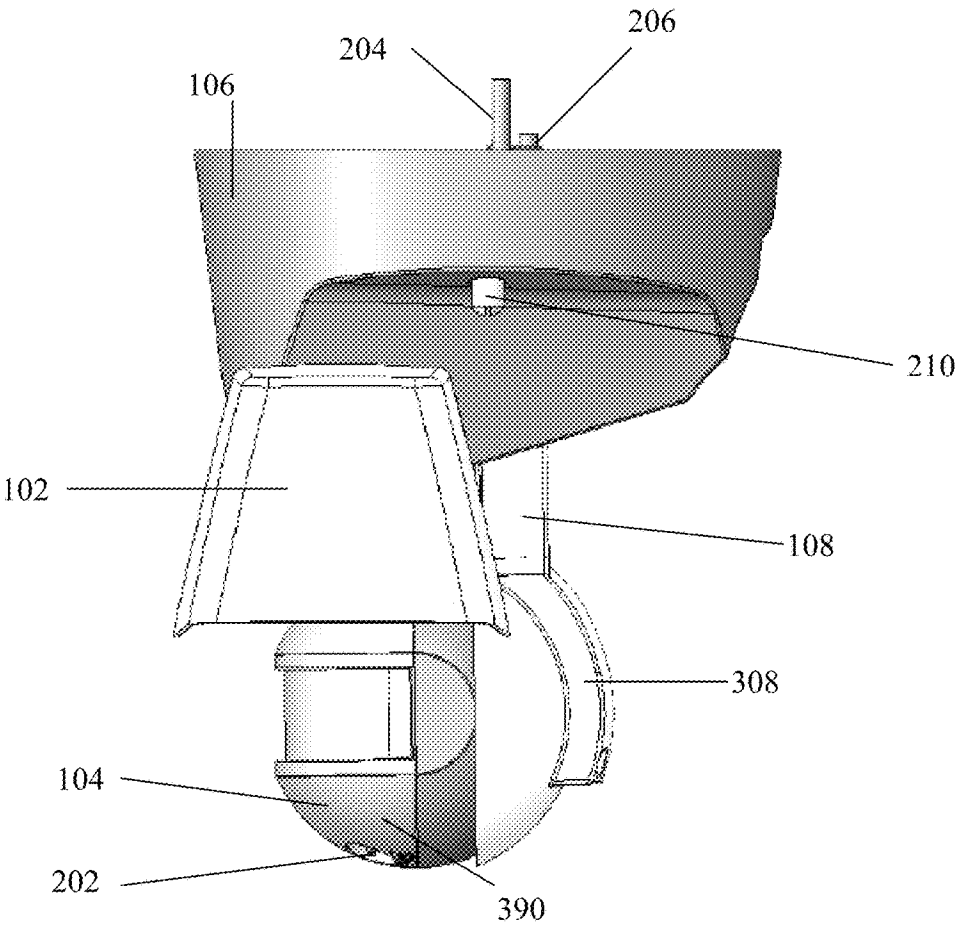
FIG. 4 illustrates a side view of the light fixture having the adjustable motion sensor where the adjustable motion sensor is in an extended position, in accordance with example embodiments of the present disclosure.
Figure 5:
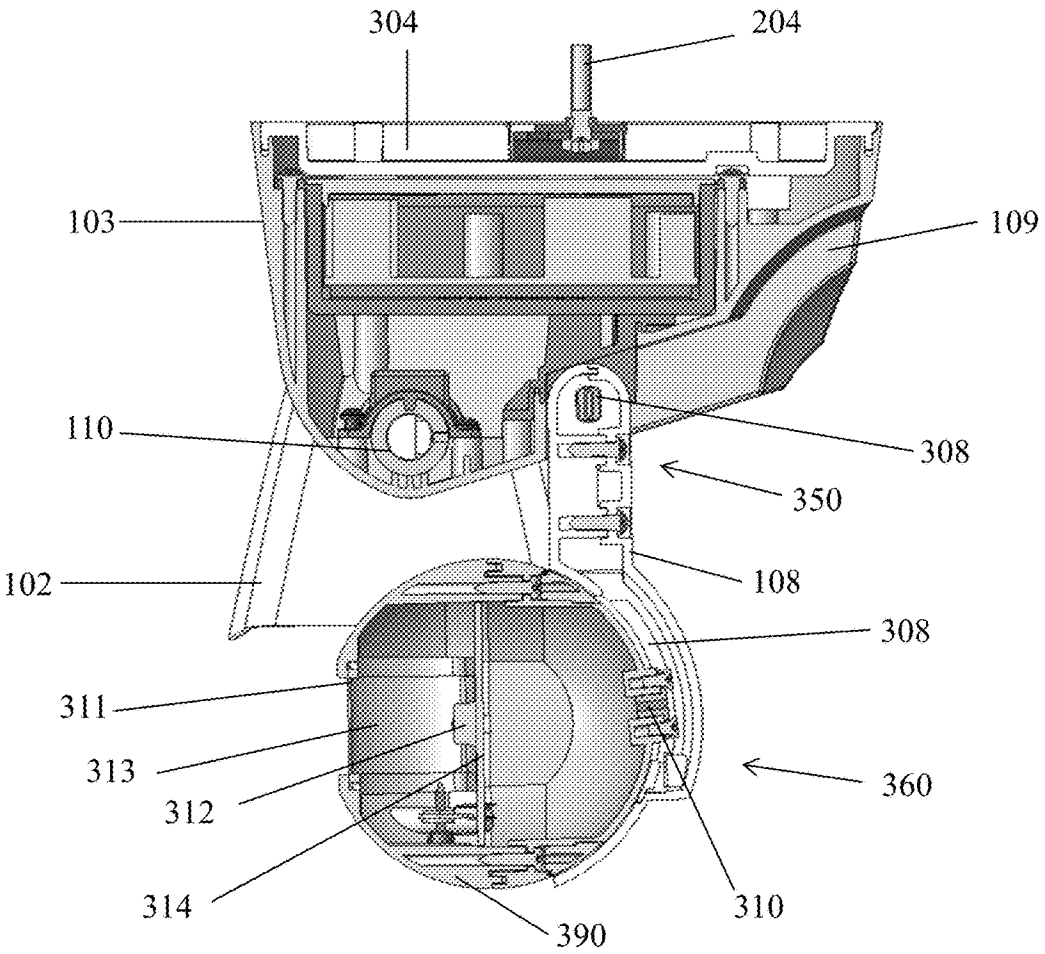
FIG. 5 illustrates a cross-sectional view of the light fixture having the adjustable motion sensor is in the extended position as illustrated in FIG. 4, in accordance with example embodiments of the present disclosure.
Figure 8:
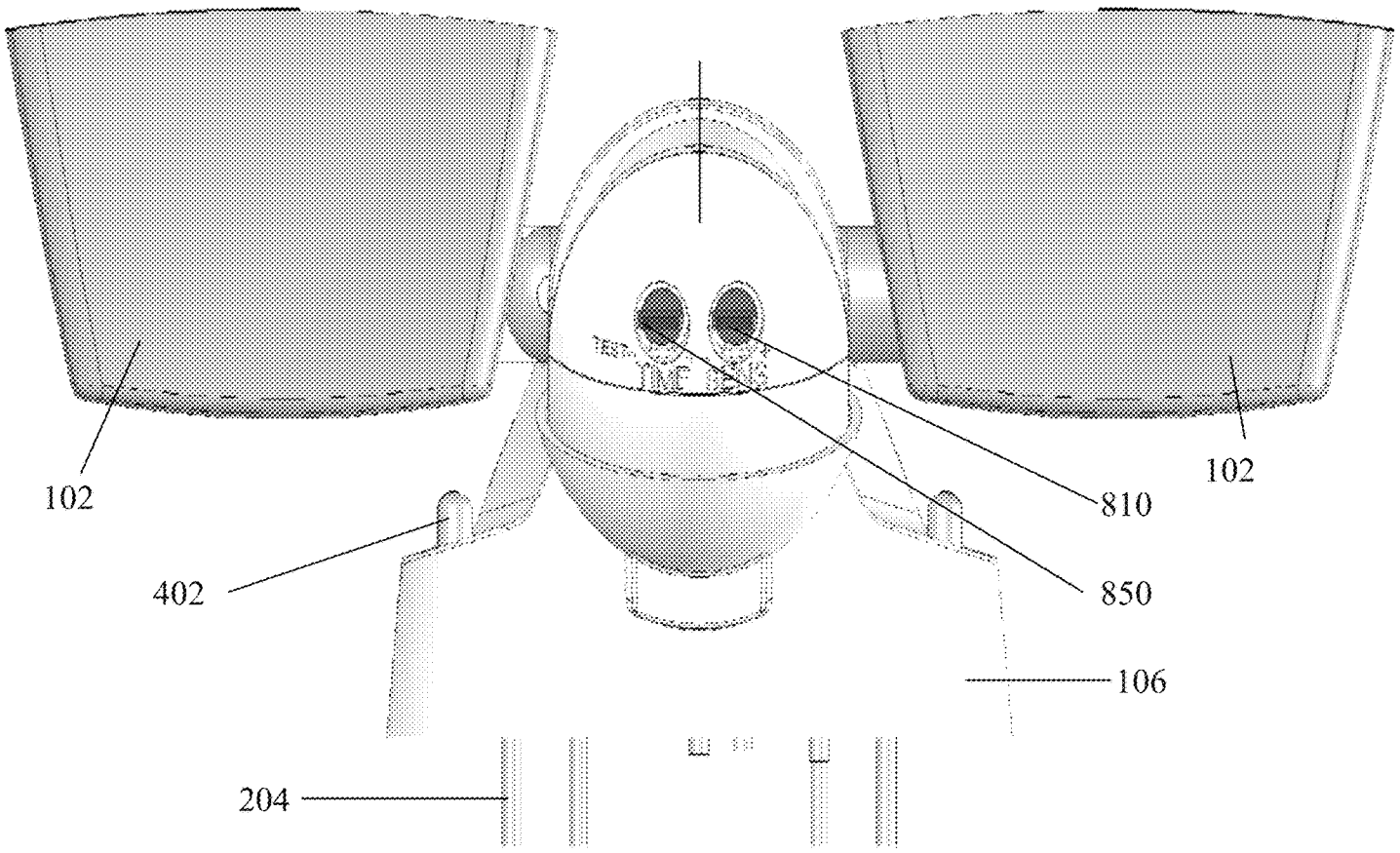
FIG. 8 illustrates a bottom view of the light fixture of FIG. 1A, in accordance with example embodiments of the present disclosure.
Figure 9:
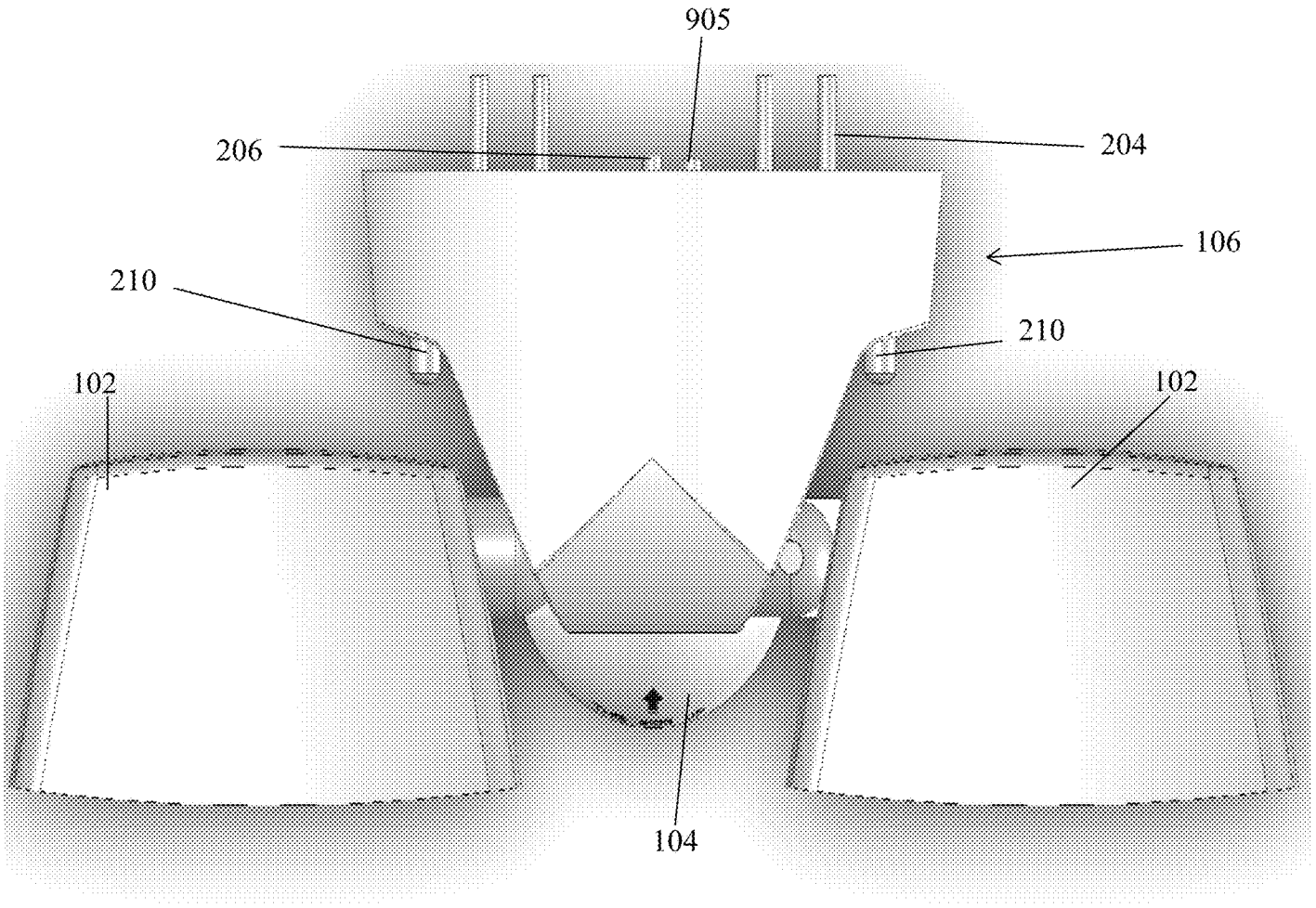
FIG. 9 illustrates a top view of the light fixture of FIG. 1A, in accordance with example embodiments of the present disclosure.
Figure 10:
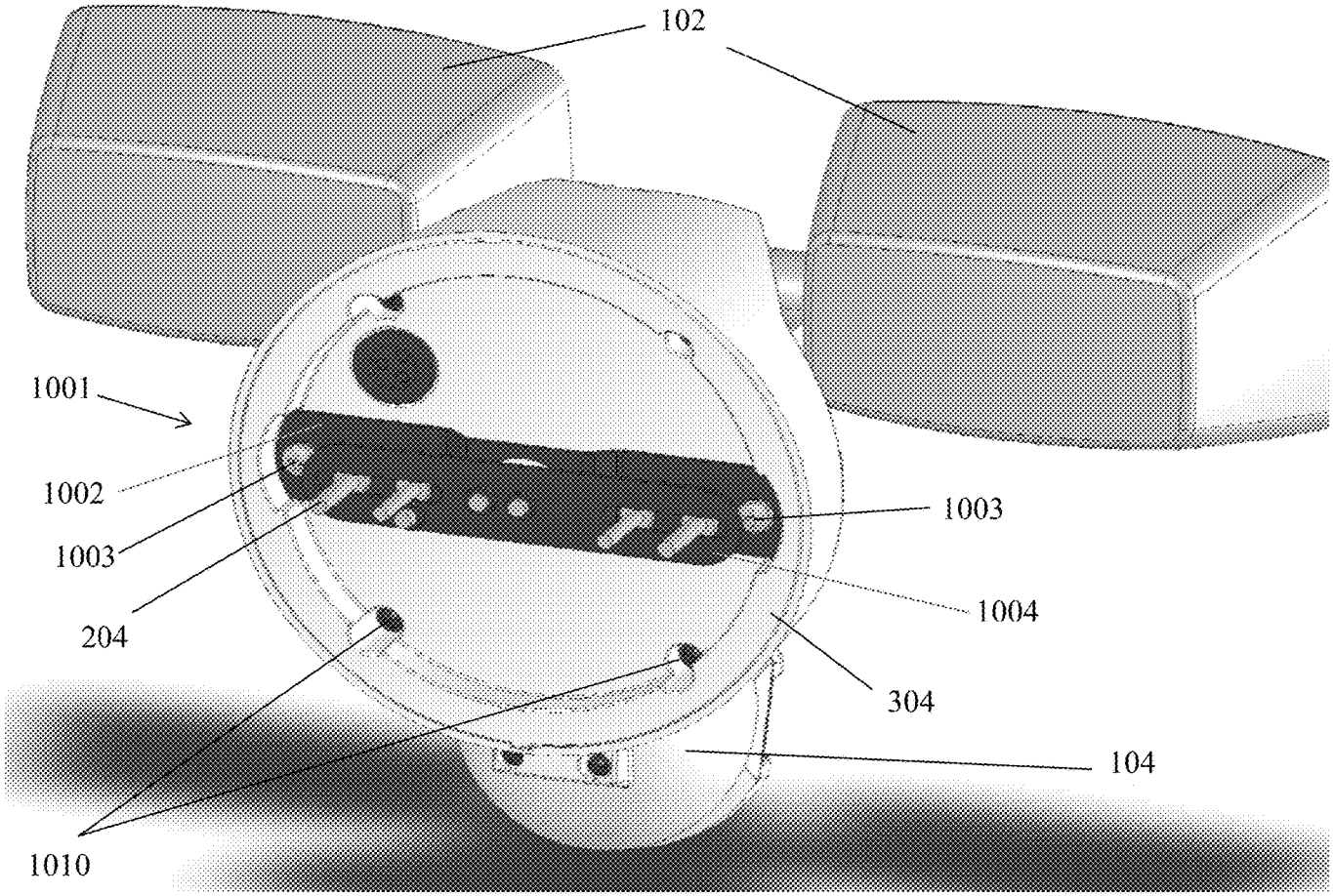
FIGS. 10-12 illustrate a rotatably adjustable mounting bracket assembly on the rear side of the light fixture, in accordance with example embodiments of the present disclosure.
Figure 11:
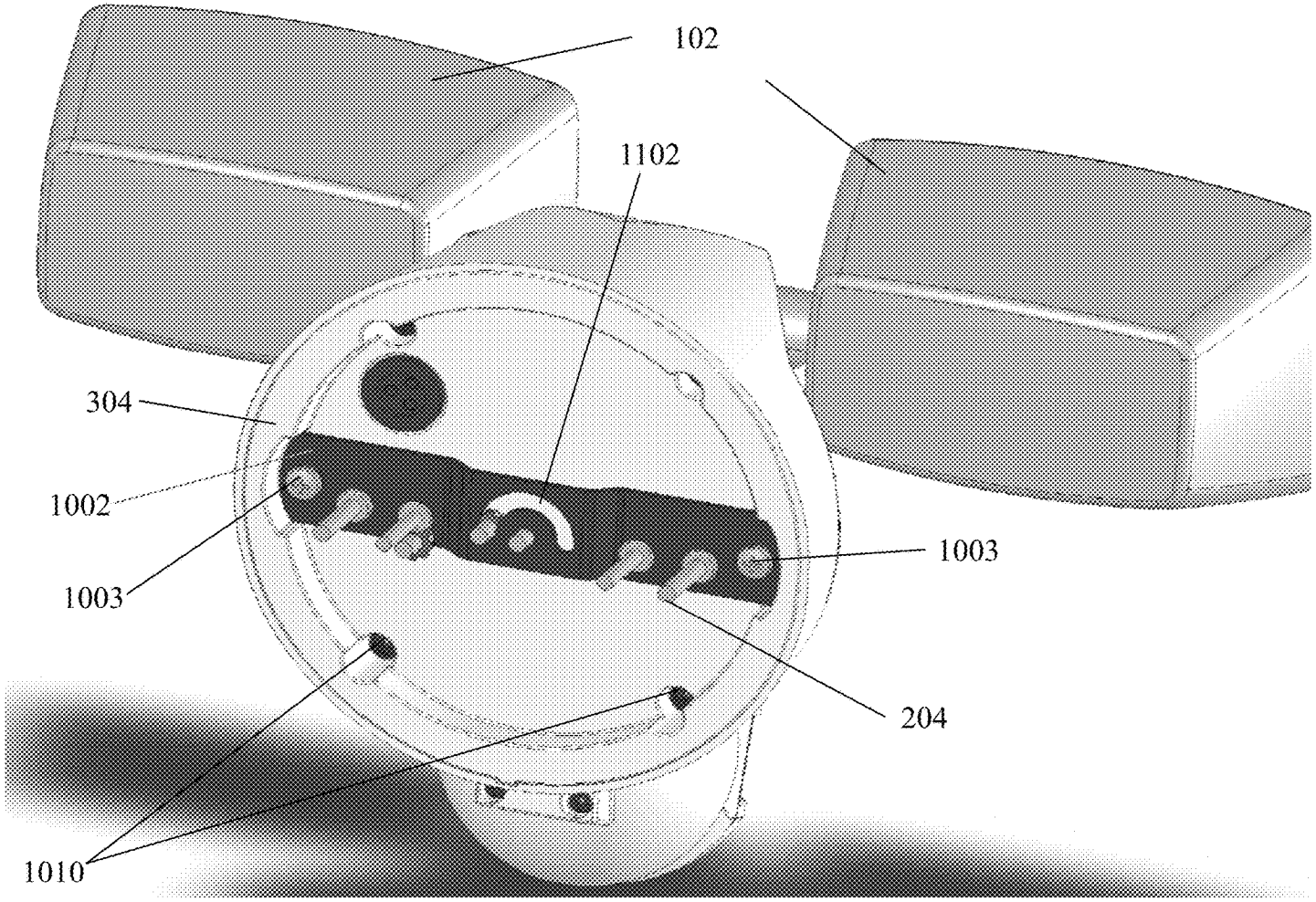
Figure 12:
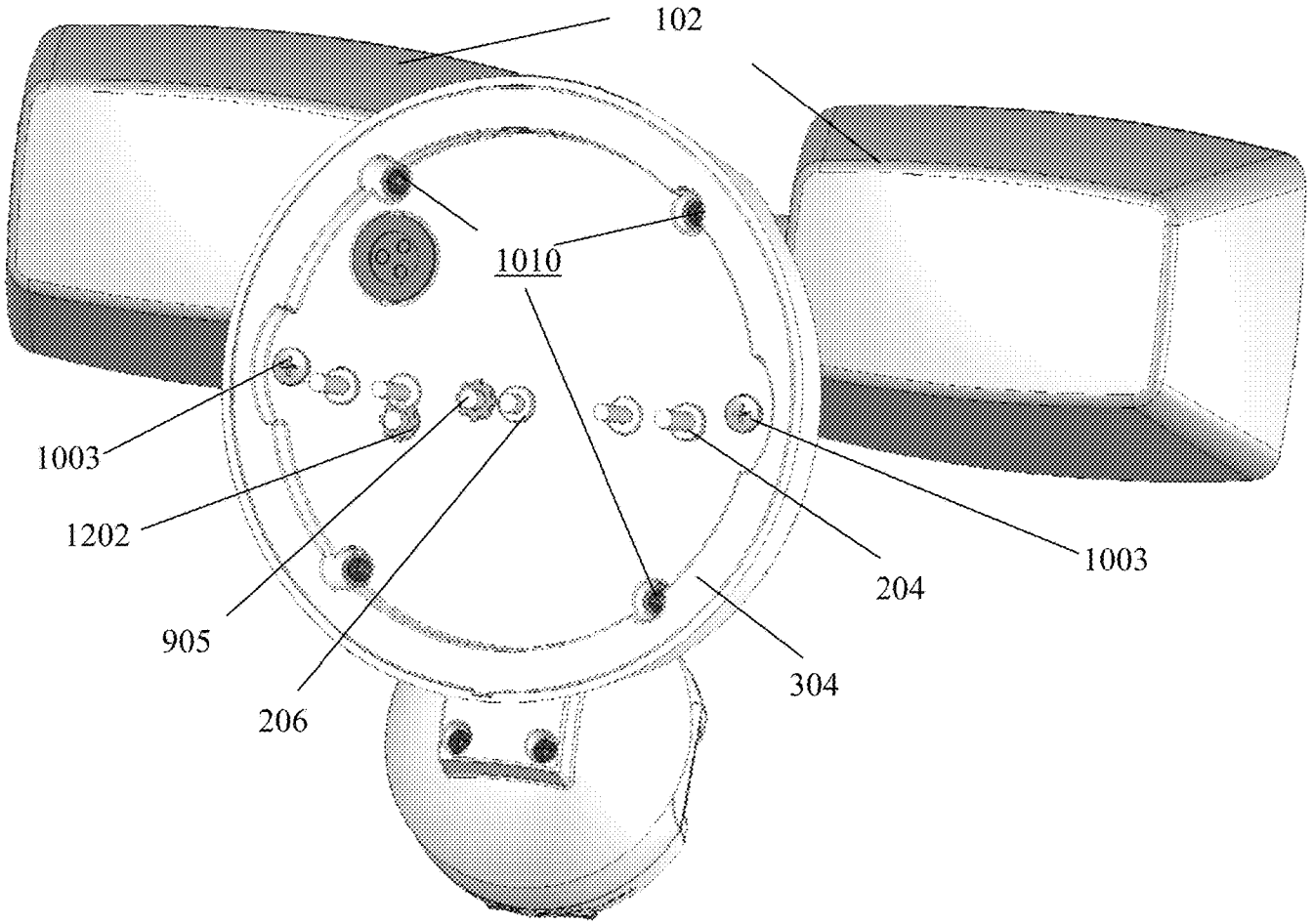

Turning to FIG. 1A, this figure illustrates a front view of a light fixture having an adjustable motion sensor where the light fixture having the adjustable motion sensor is in a wall mounted position, in accordance with example embodiments of the present disclosure. FIG. 1B illustrates a canopy member of the housing of the light fixture, in accordance with example embodiments of the present disclosure. FIGS. 1A and 1B are collectively referred to as FIG. 1. FIG. 2 illustrates a side view of the light fixture of FIG. 1A, in accordance with example embodiments of the present disclosure. FIG. 3 illustrates a cross-sectional view of the light fixture where the adjustable motion sensor is in the retracted position as illustrated in FIGS. 1A and 2, in accordance with example embodiments of the present disclosure. FIG. 4 illustrates a side view of the light fixture having the adjustable motion sensor where the adjustable motion sensor is in an extended position, in accordance with example embodiments of the present disclosure. FIG. 5 illustrates a cross-sectional view of the light fixture having the adjustable motion sensor in the extended position as illustrated in FIG. 4, in accordance with example embodiments of the present disclosure. FIG. 8 illustrates a bottom view of the light fixture of FIG. 1A, in accordance with example embodiments of the present disclosure. FIG. 9 illustrates a top view of the light fixture of FIG. 1A, in accordance with example embodiments of the present disclosure. FIGS. 10-12 illustrate a rotatably adjustable mounting bracket assembly on the rear side of the light fixture, in accordance with example embodiments of the present disclosure.

Referring to FIGS. 1-5 and 8-12, an example motion activated light fixture 100 (herein 'light fixture 100') may include a housing 106. The housing 106 may include a canopy member 103 (alternatively referred to as 'top member of housing') and a mounting base member 304 (alternatively referred to as 'bottom member of housing') that are coupled to each other using one or more coupling members, e.g., screws 1010. Further, the housing includes a cavity that houses one or more electrical and/or mechanical components associated with the light fixture 100, e.g., LED driver, wires, rotatable and pivoting coupling members, etc.

Turning to FIGS. 9-12, the mounting base member 304 of the housing 106 may include a mounting bracket assembly 1001 that is rotatably adjustable for mounting the light fixture 100 to a mounting surface, e.g., ceiling or wall. In particular, the mounting bracket assembly 1001 may include a light fixture mounting bar 1002 that is coupled to the mounting bracket assembly 1001 via coupling members, e.g., screws 1003, that pass through the canopy member 103 and extend beyond a front surface of the housing 106. The portion of the screws 1003 that couple the light fixture mounting bar 1002 to the mounting bracket assembly 1001 and extend beyond the housing 106 may be covered using decorative nuts 210 as illustrated in FIGS. 2, 4, and 9. The light fixture mounting bar 1002 may include a substantially arc shaped adjustment slot 1102 that is configured to retain a pivot screw 206 and a clamp screw 905 adjacent to the pivot screw 206. The pivot screw 206, the clamp screw 905 and the adjustment slot 1102 may be configured to operate in concert to allow a junction box bar 1004 to rotate approximately 180 degrees, which allows the light fixture 100 to be adjusted so that it is mounted in a suitable orientation relative to the mounting surface, e.g., wall, eave, or ceiling. In particular, the mounting bracket assembly 1001 includes toothed washers 1202, one on the pivot screw 206 and one on the clamp screw 905 which help clamp the mounting bracket assembly 1001 and thereby the light fixture 100 into its final position after all adjustments are completed.

In addition to the light fixture mounting bar 1002, the mounting bracket assembly 1001 may include a junction box bar 1004 that is configured to engage with the pivot screw 206 and the clamp screw 905. The junction box bar 1004 may be configured to retain one or more screws 204 for mounting the light fixture 100 to a junction box. The example embodiment of FIGS. 9-12 illustrates four screws 204, two of which mount the light fixture 100 to a standard fixture junction box, and two of which mount the light fixture 100 to a junction box requiring larger thread size screws for mounting. Accordingly, two of the screws 204 have one thread size and the other two have another thread size. One of ordinary skill in the art can understand and appreciate that even though four screws are shown in FIGS. 9-12, only two may be present at any given time and used for mounting the light fixture 100 on the junction box while the other two may be included in a parts bag to account for junction boxes that need a larger thread size screw. The junction box bar 1004 may pivot relative to the light fixture mounting bar 1002 based on the operation of pivot screw 206 and the clamp screw 905 for aligning the screws 204 to the position of the screw bosses in a standard fixture junction box. Even though the present disclosure illustrates and describes a mounting bracket assembly 1001 having specific components and structure, one of ordinary skill in the art can understand and appreciate that any other mounting assemblies that allow a variety of mounting adjustments may be used without departing from a broader scope of the present disclosure.

Referring back to FIGS. 1-5 and particularly to FIG. 1A, the canopy member 103 of the housing 106 may include one or more lamp holder openings 111 located on a top portion 150 of the canopy member 103 for coupling a respective light module (101*a*, 101*b*) to the housing 106. Further, the canopy member 103 may include a sensor housing opening 105 located on a bottom portion 160 of the canopy member 103. The sensor housing opening 105 may include a coupling portion 107 for coupling the motion sensor module 120 to the housing 106 and a recess portion 109 (herein 'recess 109') for housing at least a portion of the motion sensor module 120. In an example embodiment, as illustrated in FIGS. 1-5 and 8-12, the housing 106 may have a substantially circular shape; however, in other embodiments, the housing may have any other geometric or non-geometric shape without departing from a broader scope of the present disclosure. Further, even though the present disclosure describes the lamp holder openings 111 being located at a top portion 150 of the canopy member 103 and the sensor housing opening 105 being located at a bottom portion 170 of the canopy member 103, one of ordinary skill in the art can understand that the lamp holder openings and the sensor housing opening can be located at any other appropriate portion of the housing without departing from a broader scope of the present disclosure. In other words, the location of the light modules (101*a*, 101*b*) and motion sensor module 120 in the housing 106 is not limited to the illustration of FIGS. 1-5 and 8-12, and can be located at any other portion of the housing 106 without departing from a broader scope of the present disclosure.

Each light module (101*a*, 101*b*) may include a lamp holder 102 that is configured to house one or more light sources, such as, inter alia, an incandescent lamp, a high intensity discharge (HID) lamp, a light emitting diode (LED) lamp, a halogen lamp, a fluorescent lamp, or any other suitable type of light source. The lamp holders 102 may be rotatably coupled to the housing 106 using a knuckle joint 110 that is appropriately positioned in the respective lamp holder opening 111 of the canopy member 103. The knuckle joints 110 may be configured to allow the lamp holder 102 to be variably positioned three dimensionally. Accordingly, a user can direct light emitted from the light sources in various directions by adjustment of the light holders 102.

Although the present disclosure describes using knuckle joints to rotatably couple the light modules 101 to the housing 106, one of ordinary skill in the art can understand and appreciate that other coupling devices can be used to couple the lamp holder to the housing and/or variably position the lamp holder with respect to the housing without departing from a broader scope of the present disclosure. Further, one of ordinary skill in the art can understand that the light fixture embodiment of FIGS. 1-5 and 8-12 illustrating two lamp holders is an example and is not limiting. That is, in other embodiments, the light fixture 100 can include lesser or more number of lamp holders without departing from a broader scope of the present disclosure.

As described above, in addition to the one or more light modules (101*a*, 101*b*), the light fixture 100 may include a motion sensor module 120. The motion sensor module 120 may include a motion sensor unit 104 and an extension arm 108. The motion sensor unit 104 may be coupled to the housing 106 via the extension arm 108. In particular, a first end 350 of the extension arm 108 may be pivotably coupled the housing 106 and a second end 360 of the extension arm 108 that is opposite to the first end 350 may be coupled to the motion sensor unit 104. The extension arm 108 is described in greater detail below in association with FIGS. 6 and 7.

Figure 6:
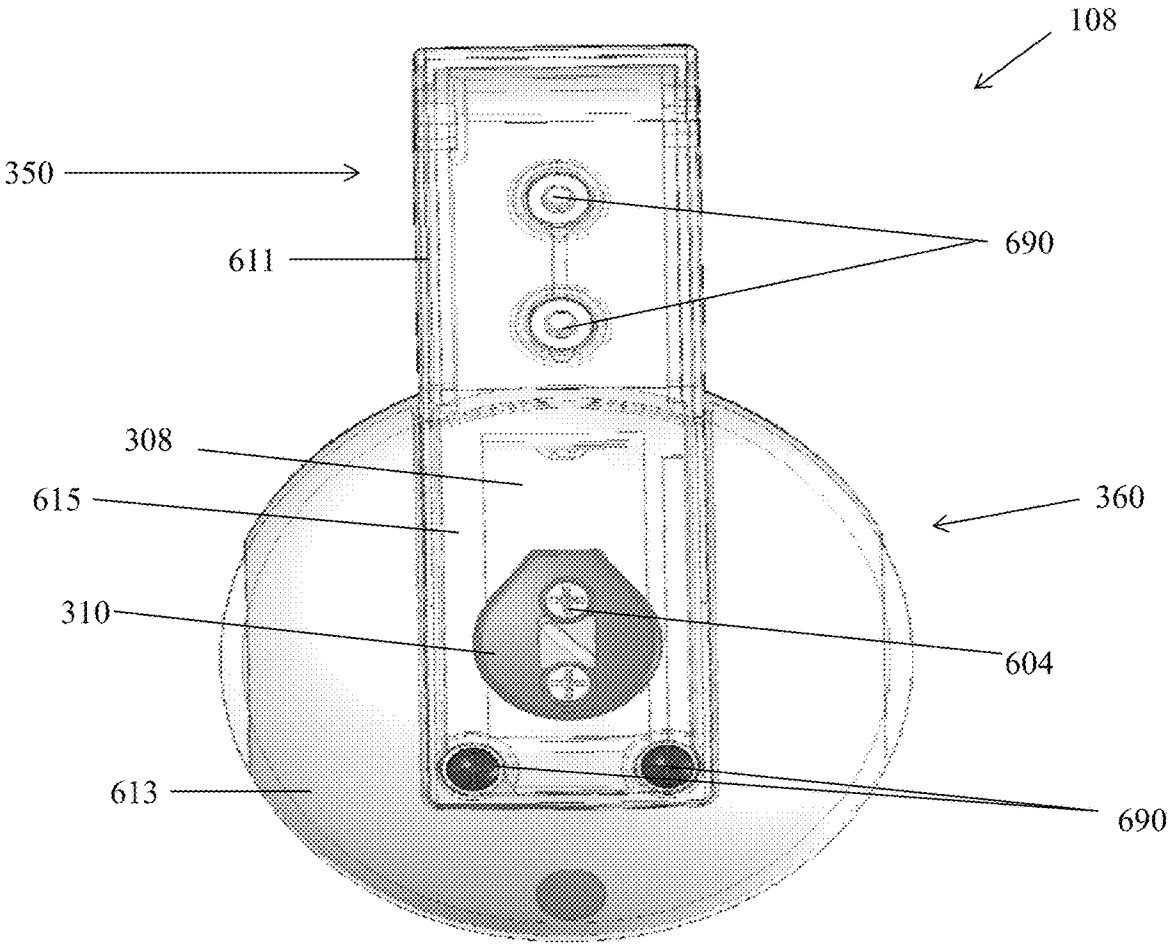
FIG. 6 illustrates a rear view of the motion sensor module of the light fixture having a motion sensor unit rotatably coupled to an extension arm using a sliding friction plate, in accordance with example embodiments of the present disclosure.
Figure 7B:
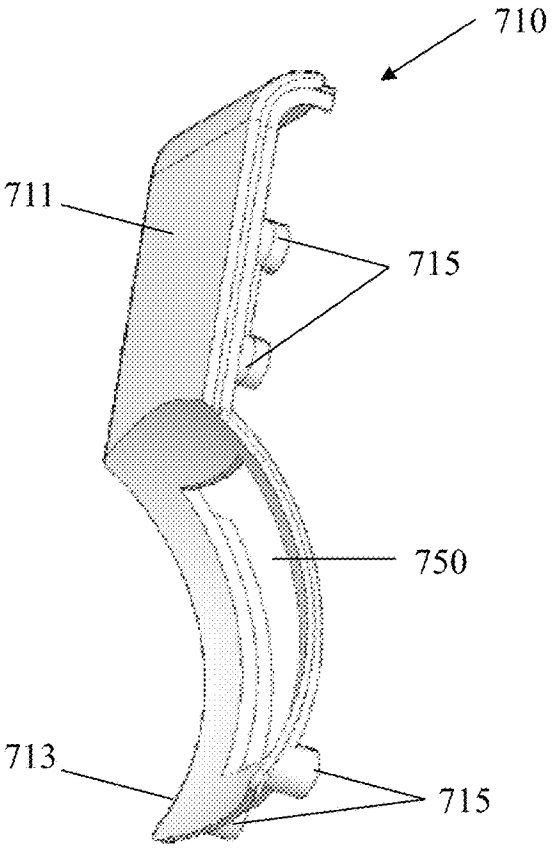
FIGS. 7A-7B (collectively 'FIG. 7') illustrates a top member and a bottom member of the extension arm, in accordance with example embodiments of the present disclosure.
Figure 7A:
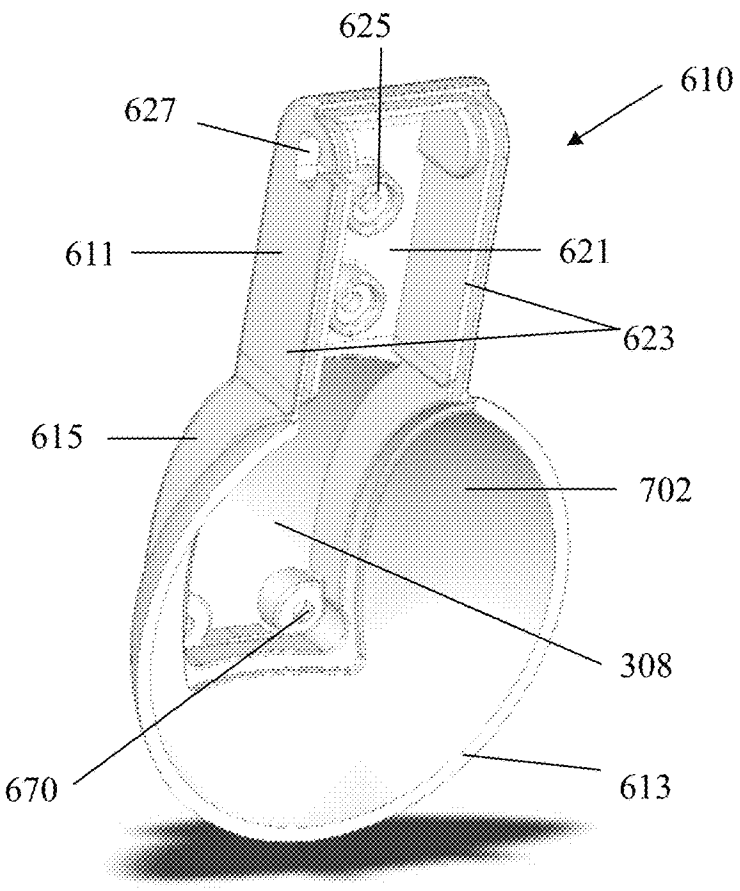

Turning to FIGS. 6 and 7, these figures illustrate perspective views and the structure of the extension arm 108. In particular, FIG. 6 illustrates a rear view of the motion sensor module of the light fixture having a motion sensor unit rotatably coupled to an extension arm using a sliding friction plate, in accordance with example embodiments of the present disclosure; and FIGS. 7A-7B (collectively 'FIG. 7') illustrates a top member and a bottom member of the extension arm, in accordance with example embodiments of the present disclosure.

Referring to FIGS. 6 and 7, the extension arm may include a top member 710 and a bottom member 610 that are coupled to each other via one or more coupling members, e.g., screws 690. The bottom member 610 may include an upper portion 611, a curved lower portion 613, and a protrusion portion 615. In general, the side profile of the bottom member 610 may approximately resemble a spoon where the upper portion 611 may approximately resemble the handle of the spoon and the curved lower portion 613 may approximately resemble the bowl portion of the spoon. In other words, the upper portion 611 may have a substantially rectangular cross-sectional shape and the lower portion 613 may have a substantially semi-circular cross-sectional shape (cross-section taken along an X-Z plane).

The upper portion 611 of the bottom member 610 may include a base panel 621 and two side panels 623 that extend substantially perpendicularly from opposite longitudinal edges of the base panel 621. The base panel 621 includes apertures 625 for receiving the coupling members 690 that couple the bottom member 610 to the top member 710 to form the extension arm 108. Further, each side panel 623 includes an aperture 627 (at a first end 350) for receiving coupling members 306 (shown in FIGS. 3 and 5) that are configured to rotatably couple the extension arm 108 to the housing 106. The aperture 627 may be a through aperture or a blind aperture that does not extend through the side panel 623. The coupling members 306 may include, inter alia, rods, pins, or any other coupling devices configured to rotatably couple the first end 350 extension arm 108 to the housing 106. In particular, the coupling members 306 form a pivoting axis (axial to the coupling members 306 in FIGS. 3 and 5) about which the extension arm rotates pivoting between a first position and a second position. In other words, the extension arm 108 may pivotally rotate about an axis passing through (a) the points of intersection of the extension arm 108 with the housing 106 and (b) the apertures 627 at the first end of the extension arm 108, and (c) the coupling members 306. In the first position, the extension arm 108 and the motion sensor unit 104 coupled to the extension arm 108 may be refracted and disposed in the recess portion 109 of the housing 106. Further, in the second position, the extension arm 108 and the motion sensor unit 104 coupled to the extension arm 108 may be extended out and away from the recess 109 of the housing 106.

For example, when the motion activated light fixture 100 is wall mounted, the extension arm 108 may be retracted such that the motion sensor unit 104 rests in the recess 109 of the housing 106 as illustrated in FIGS. 1-3 and 8-12. However, when the motion activated light fixture 100 is ceiling mounted, the extension arm 108 may be extended out from the recess 109 of the housing 106 as illustrated in FIGS. 4 and 5. Even though FIGS. 1-3 and 8-12 illustrate the extension arm in a fully retracted position and FIGS. 4 and 5 illustrate the extension arm 108 in a fully extended position, one of ordinary skill in the art can understand and appreciate that the extension arm 108 can be adjusted to partially extended position and rest in any position between the fully retracted position and fully extended position in both wall and ceiling mounting without departing from a broader scope of the present disclosure.

In the example embodiment of FIGS. 1-3, 8, and 9, in a fully retracted position, the recess portion 109 fully accommodates the extension arm such that the extension arm is substantially flush with the housing 106. However, in the fully retracted position, only a portion of the motion sensor unit 104 is housed by the recess 109 while a remaining portion of the motion sensor unit 104 protrudes out from the recess 109 and the housing 106 as illustrated in the example embodiment of FIGS. 1-3, 8, and 9. In another example embodiment, similar to the motion sensor unit 104, only a portion of the extension arm 108 may be accommodated in the recess 109 in a fully retracted position. In yet another example embodiment, the recess portion 109 of the housing may be configured to accommodate the extension arm 108 and the motion sensor unit 104 in its entirety such that no portion of the motion sensor unit 104 and the extension arm 108 protrudes from the housing 106 and the motion sensor module 120 is substantially flush with the housing 106 in the fully refracted position.

Further, in a fully extended position, the extension arm 108 may be substantially normal to the housing 106 (particularly the mounting base member 304) as illustrated in FIGS. 4 and 5. However, one of ordinary skill in the art can understand and appreciate that in other embodiments, the extension arm 108 may be configured to extend all the way from the bottom portion 160 of the housing 106 to a top portion 150 of the housing 106 without departing from a broader scope of the present disclosure. Further, one of ordinary skill in the art can understand and appreciate that in other embodiments, the extension arm may be coupled to the housing such that the extension arm can additionally rotate about a longitudinal axis passing through the length of the extension arm without departing from a broader scope of the present disclosure.

Turning back to FIGS. 6 and 7, in addition to the upper portion 611 and the curved lower portion 613, the bottom member 610 of the extension arm 108 may include the protrusion portion 615. The protrusion portion 615 may be a protrusion that extends outward from the curved lower portion 613 of the bottom member 610. The protrusion portion 615 may form a cavity 308 that protrudes beyond a cavity 702 formed by the curved lower portion 613 as illustrated in FIG. 7. In particular, the protrusion portion 615 may follow a curve of the curved lower portion 613 and extend generally from a portion of intersection between the upper and curved lower portions (611, 613) to approximately the vertex (mid-point) of the curved lower portion 613. Accordingly, the cavity 308 formed by the protrusion portion 615 may extend half way along the middle of curved lower portion 613. Further, the protrusion portion 615 may include apertures 670 configured to receive coupling members, e.g., screws 690 to couple the bottom member 610 of the extension arm 108 to the top member 710 of the extension arm.

As illustrated in FIG. 6, the cavity 308 formed by the protrusion portion 615 may be configured to house a friction plate 310 while the cavity 702 formed by the curved lower portion 613 may be configured to house at least a portion of the motion sensor housing 390 (as shown in FIGS. 3 and 5).

In addition to the bottom member 610, the extension arm 108 includes a top member 710. As illustrated in FIG. 7B, the top member 710 includes an upper portion 711 and a lower portion 713. In particular, the upper portion 711 of the top member 710 is substantially rectangular shaped and includes coupling device receiving members 715, e.g., screw boss. The coupling device receiving members 715 are configured to align with the apertures 625 on the base panel 623 of the bottom member 610 and receive coupling devices, e.g., screws 690 therethrough when the top member 610 is coupled to the bottom member 710. Further, the lower portion 713 of the top member 710 may be curved substantially similar to the curve of the protrusion portion 615 of the bottom member 610. Similar to the upper portion 711, the lower portion 713 may include one or more screw bosses that are configured to be aligned with the apertures 670 of the bottom member 610 to receive coupling members 690 when the top member 610 is coupled to the bottom member 710. Additionally, the lower portion 713 of the top member 710 may include an elongated slot 750. In particular, the lower portion 713 of the top member 710 may be configured to seal the cavity 308 formed by the protrusion portion 615 when the top member 710 is coupled to the bottom member 610, and the elongated slot 750 provides access to the cavity 308 once the cavity is sealed 308.

In an example embodiment, the motion sensor unit 104 may be coupled to the extension arm 108 by coupling the friction plate 310 to the motion sensor housing 390 using coupling members, e.g., screws 604. The coupling members 604 pass through the friction plate disposed in the cavity 308 formed by the protrusion portion 615, the slot 750, and the motion sensor housing 390 disposed in the cavity 702 formed by the curved lower portion 613 to couple the motion sensor unit 104 to the extension arm 108. In particular, the friction plate 310 is configured to slide along the slot 750 to provide an additional degree of adjustment to the motion sensor unit 104. That is, the sliding friction plate 310 allows a rotation of the motion sensor unit 104 independent of a motion of the extension arm 108.

Even though the present disclosure describes a two-part extension arm 108 having a top member 710 and a bottom member 610, one of ordinary skill in the art can understand and appreciate that the extension arm 108 may be designed as a single part component or component having more than two parts without departing from a broader scope of the present disclosure. Further, even though the present disclosure describes the top member 710 and the bottom member 610 of the extension arm 108 being coupled using screws, one of ordinary skill in the art can understand and appreciate that any other coupling mechanism may be used to couple the different parts of the extension arm without departing from a broader scope of the disclosure. For example, the top member 710 may be designed to snap onto the bottom member 610 to form the extension arm 108. Furthermore, even though the present disclosure describes a specific structure and shape for the extension arm and each member of the extension arm, one of ordinary skill in the art can understand and appreciate that the extension arm can have any other appropriate shape without departing from a broader scope of the present disclosure. For example, the extension arm may be designed to have a cylindrical shape. Further, the extension arm may be designed to accommodate more than one sensor unit at either an end portion or any other portion of the extension arm. Alternatively, the extension arm may be designed to have telescopic members configured to telescopically extend and retract. Additionally, even though the present disclosure describes a sliding friction plate-slot mechanism for providing the motion sensor unit 104 the ability to rotate, one of ordinary skill in the art can understand and appreciate that any other appropriate mechanism can be used to provide the motion sensor unit 104 the ability to rotate without departing from a broader scope of the present disclosure. For example, a slot/groove and track mechanism may be provided for rotation of the motion sensor unit 104 where tracks may be provided on the motion sensor housing 390 that are configured to engage the slot 750 to provide a desired rotation. Alternatively, other mechanisms may be provided for rotation of the motion sensor unit 104 along the X, Y, and/or Z axis without departing from a broader scope of the present disclosure.

Referring back to FIGS. 1-5 and 8-12, the motion sensor unit 104 includes a motion sensor housing 390 which is substantially spherical in shape. However, in other embodiments, the motion sensor housing 390 may have any other appropriate shape without departing from a broader scope of the present disclosure. The motion sensor housing 390 may be configured to house a circuit board 314 and a motion sensor 312 coupled to the circuit board 314. Further, the motion sensor housing 390 may include an opening 313 that is directed towards the area to be monitored. This opening 313 is covered by a lens 311. In certain example embodiments, the lens 311 may be an extra wide lens design and is fabricated using a translucent material or any other suitable material known to those having ordinary skill in the art. In particular, the motion sensor 312 and the circuit board 314 to which the motion sensor 312 is coupled are located behind the lens 311 within the motion sensor housing 390.

Further, as illustrated in FIG. 8, the motion sensor unit 104 includes a sensitivity setting control knob 810 and time setting control knob 850 positioned along the bottom of the motion sensor housing 390. Positioning the control knobs 810 and 850 along the bottom of the motion sensor housing 390 provides easier access for a consumer using the light fixture 100. Alternatively, control knobs 710 and 750 have another shape or form, such as a sliding switch or a push button, and are positioned along other portions of the motion sensor housing 390 or other portions of the light fixture 100 in general.

According to the exemplary embodiment shown in FIG. 8, the control knobs 810 and 850 are adjusted by rotating, either clockwise or counter-clockwise, as the situation requires. In particular, the exemplary sensitivity setting control knob 810 may be used to reduce or increase the distance at which motion is detected, i.e., a sensitivity of the motion sensor. Similarly, the time setting control knob 750 may be used to control the time period that the light source stays on once motion is detected. The exemplary time setting control knob 850 may also include a test mode 870, where the light fixture 100 can operate day or night but the light source stays on for only a few seconds when motion is detected. In one exemplary embodiment, the test mode 870 may be used during the initial setup of the motion detector system 100 for aiming purposes. Thus, a user is able to move around the monitored area to verify the sensitivity of the motion sensor and iteratively adjust the sensitivity setting control knob 810 until the desired sensitivity is achieved.

Although embodiments described herein are made with reference to example embodiments, it should be appreciated by those skilled in the art that various modifications are well within the scope and spirit of this disclosure. For example, each feature of one embodiment can be mixed and matched with other features shown in other embodiments.

Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A light fixture comprising:
a housing;
one or more light modules coupled to the housing;
a sensor module coupled to the housing, the sensor module comprising:
an extension arm pivotably coupled to the housing at a first end of the extension arm such that the sensor module is adjustable between a first position and a second position,
wherein the extension arm comprises a top member and a bottom member that are coupled to each other to form a cavity to hold a friction plate,
wherein the friction plate is coupled to a sensor unit, and
wherein the top member of the extension arm comprises a slot along which the friction plate is configured to slide such that the sensor unit is rotatable based on a motion of the friction plate along the slot.

2. The light fixture of claim 1, wherein the first position is a retracted position where the sensor module is disposed within a recess in the housing and the second position is an extended position where the sensor module is extended out and away from the recess in the housing.

3. The light fixture of claim 1, wherein the sensor unit is rotatable independent of the extension arm.

4. The light fixture of claim 1, wherein the sensor module is in the second position when the light fixture is ceiling mounted.

5. The light fixture of claim 1, wherein the sensor module is in the first position when the light fixture is wall mounted.

6. A light fixture comprising:
a housing comprising a recess portion;
one or more light modules coupled to the housing;

a sensor module pivotably coupled to the housing such that the sensor module pivots between a first position where the sensor module is disposed within the recess and a second position where the sensor module is extended out and away from the recess, wherein the sensor module comprises:

an extension arm comprising a top member and a bottom member that are coupled to each other to form a cavity to hold a friction plate; and a sensor unit rotatably coupled to the friction plate at a distal end of the extension arm, wherein the top member of the extension arm comprises a slot along which the friction plate is configured to slide such that the sensor unit is rotatable based on a motion of the friction plate along the slot.

7. The light fixture of claim 6, wherein the sensor unit comprises a motion sensor.

8. The light fixture of claim 6, wherein the sensor module is in the first position when the light fixture is wall mounted.

9. The light fixture of claim 6, wherein the sensor module is in the second position when the light fixture is ceiling mounted.

10. A motion sensor module comprising:

an extension arm adapted to be rotatably coupled to a housing of a light fixture at a first end; and a motion sensor unit rotatably coupled to a second end of the extension arm that is opposite to the first end, wherein the extension arm pivots between a first position where the motion sensor module is disposed within a recess of the housing and a second position where the motion sensor module is extended out and away from the recess of the housing, wherein the extension arm comprises a top member and a bottom member that are coupled to each other to form a cavity to hold the friction plate, wherein the friction plate is coupled to the motion sensor unit; and wherein the top member of the extension arm comprises a slot along which the friction plate is configured to slide such that the motion sensor unit is rotatable based on a motion of the friction plate along the slot.

11. The motion sensor module of claim 10, wherein the motion sensor module is in the first position when the light fixture is wall mounted.

12. The motion sensor module of claim 10, wherein the motion sensor module is in the second position when the light fixture is ceiling mounted.

13. The motion sensor module of claim 10:

wherein the motion sensor unit comprises a motion sensor housing configured to house a motion sensor and electrical components associated with the motion sensor, and wherein the motion sensor housing comprises one or more control knobs to adjust at least one sensor characteristic of the motion sensor.

14. The motion sensor module of claim 13, wherein the motion sensor housing is coupled to the extension arm via the friction plate and the slot such that the motion sensor unit is rotatable independent of a position of the extension arm.

15. The motion sensor module of claim 10, wherein the recess of the housing is configured to house the extension arm and at least a portion of the motion sensor unit.

* * * * *